US009238545B2

(12) United States Patent
Bae et al.

(10) Patent No.: US 9,238,545 B2
(45) Date of Patent: Jan. 19, 2016

(54) CARTRIDGE FOR MEDICATION DISPENSING APPARATUS HAVING ROLL-ROTATING DRUM

(71) Applicant: Infopia Co., Ltd, Anyang-si (KR)

(72) Inventors: Byeong-Woo Bae, Anyang-si (KR); Keun-Young Kim, Seoul (KR)

(73) Assignee: Infopia Co., Ltd., Anyang-si (KR)

( * ) Notice: Subject to any disclaimer, the term of this patent is extended or adjusted under 35 U.S.C. 154(b) by 0 days.

(21) Appl. No.: 13/948,584

(22) Filed: Jul. 23, 2013

(65) Prior Publication Data

US 2014/0203036 A1 Jul. 24, 2014

(51) Int. Cl.

| | |
|---|---|
| ***B65H 3/00*** | (2006.01) |
| ***B65D 83/04*** | (2006.01) |
| ***A61J 7/00*** | (2006.01) |
| ***G07F 11/44*** | (2006.01) |
| ***G07F 17/00*** | (2006.01) |
| *B65D 1/09* | (2006.01) |

(52) U.S. Cl.

CPC ..... *B65D 83/04* (2013.01); *A61J 7/0084* (2013.01); *B65D 83/0409* (2013.01); *G07F 11/44* (2013.01); *G07F 17/0092* (2013.01); *B65D 1/09* (2013.01)

(58) Field of Classification Search

CPC ..... B65D 1/09; B65D 83/04

USPC ..... 221/277, 265, 15, 203, 370, 258, 197; 53/155, 238, 277

See application file for complete search history.

(56) References Cited

U.S. PATENT DOCUMENTS

| | | | | |
|---|---|---|---|---|
| 3,918,607 | A * | 11/1975 | Rowlette | 221/15 |
| 3,991,908 | A * | 11/1976 | Thomas | B65D 83/0409 215/218 |
| 4,662,538 | A * | 5/1987 | Goudy, Jr. | C02F 1/687 221/15 |
| 4,711,370 | A * | 12/1987 | Goudy, Jr. | C02F 1/687 221/258 |
| 6,170,229 | B1 | 1/2001 | Kim | |
| 6,256,963 | B1 | 7/2001 | Kim | |
| 6,299,019 | B1 * | 10/2001 | Leight | 221/186 |
| 6,394,308 | B1 * | 5/2002 | Yuyama | G07F 17/0092 221/119 |

(Continued)

FOREIGN PATENT DOCUMENTS

| | | |
|---|---|---|
| JP | 2000-203502 A | 7/2000 |
| JP | 2002-370702 A | 12/2002 |

(Continued)

OTHER PUBLICATIONS

European Search Report issued Dec. 18, 2014 in counterpart Application No. EP 13176101.7.

*Primary Examiner* — Rakesh Kumar

(74) *Attorney, Agent, or Firm* — NSIP Law

(57) ABSTRACT

There is provided a cartridge for a medication dispensing apparatus having a roll-rotating drum, the cartridge including a cartridge case having an open outlet formed on a bottom thereof so as to dispense medication; a drum installed inside of the cartridge case so as to selectively open and/or close the outlet; and a cartridge base having the cartridge case installed thereto, wherein projections projected downward and grooves recessed upward are formed on a bottom of the drum, alternatively, and a concave-convex part having protruding portion protruding upward are formed on a bottom surface of the cartridge case at intervals.

4 Claims, 5 Drawing Sheets

(56) References Cited

U.S. PATENT DOCUMENTS

| | | | | |
|---|---|---|---|---|
| 6,471,093 | B1 * | 10/2002 | Kodama | B65G 47/1457 221/266 |
| 6,824,011 | B1 * | 11/2004 | Woempner | F41B 11/50 221/263 |
| 7,040,505 | B2 * | 5/2006 | Hashimoto | B65B 5/103 221/203 |
| 7,051,900 | B2 * | 5/2006 | Reeves | 221/200 |
| 7,182,219 | B2 * | 2/2007 | Chang | 221/133 |
| 7,471,023 | B2 * | 12/2008 | Roundell | 310/91 |
| 7,571,023 | B2 * | 8/2009 | Mitchell | A61J 7/02 221/200 |
| 8,746,225 | B2 * | 6/2014 | Christopher | F41B 11/57 124/51.1 |
| 9,132,060 | B2 | 9/2015 | Omura et al. | |
| 2004/0245276 | A1 | 12/2004 | Hashimoto et al. | |
| 2013/0233894 | A1 | 9/2013 | Kim | |
| 2013/0240555 | A1 | 9/2013 | Kim | |
| 2013/0267927 | A1 | 10/2013 | Omura et al. | |
| 2014/0203036 | A1 * | 7/2014 | Bae | A61J 7/0084 221/277 |

FOREIGN PATENT DOCUMENTS

| | | | |
|---|---|---|---|
| JP | 2003-104333 | A | 4/2003 |
| JP | 2011-143947 | A | 7/2011 |
| JP | 2012-120719 | A | 6/2012 |
| JP | 2014-500773 | A | 1/2014 |
| KR | 10-0735500 | | 6/2007 |
| KR | 10-1147540 | B1 | 5/2012 |
| WO | WO 2012/070883 | A2 | 5/2012 |
| WO | WO 2012/077788 | A1 | 6/2012 |

* cited by examiner

CARTRIDGE FOR MEDICATION DISPENSING APPARATUS HAVING ROLL-ROTATING DRUM

CROSS-REFERENCE TO RELATED APPLICATION

This application claims the benefit under 35 U.S.C. §119 (a) of Korean Patent Application No. 10-2013-0007610, filed on Jan. 23, 2013, in the Korean Intellectual Property Office, the entire disclosure of which is incorporated herein by reference for all purposes.

BACKGROUND

1. Field

The following description relates to a cartridge for a medication dispensing apparatus having a roll-rotating drum, the drum configured to open and/or close an outlet of a cartridge case and capable of rolling up and down.

2. Description of the Related Art

In order to solve drawbacks of pharmacist manually dispensing medication, a medication dispensing apparatus is needed. If a doctor orders medication for a prescription using a computer, the medication dispensing apparatus automatically divides medication into dose per serving. Such a medication dispensing apparatus includes a medication cabinet for keeping medication separate according to types, and a packing unit which is disposed below the medication cabinet and packs medication supplied from the medication cabinet.

The medication cabinet is configured to include a plurality of medication cartridges. A medication cartridge stores the same type medication, and dispenses the medication to the packing unit in accordance with a prescription signal. A case of the medication cartridge includes a cartridge case, having an outlet on the bottom thereof so as to dispense stored medication; a drum installed inside of the cartridge case so as to selectively open and/or close the outlet; and a cartridge base having the cartridge case installed thereon.

In the case when the drum simply repeatedly rotates on a horizontal state, it is possible to open an outlet of the cartridge case but there are some drawbacks. That is, medication contained in the cartridge case may not be distributed evenly to each cell of the drum, and it is hard to secure a time for dispensing medication regularly. In particular, if there is a large amount of medication, the medication may be not distributed effectively to each cell of the drum due to the medication's weight and pressure.

SUMMARY

The following description aims to provide a cartridge for a medication dispensing apparatus having a roll-rotating drum, the cartridge which is capable of easing concentration of medication, led by weight of the medication, and thus supplying the medication to each cell of the drum more rapidly and more reliably.

In one general aspect, there is provided a cartridge for a medication dispensing apparatus having a roll-rotating drum, the cartridge including a cartridge case having an open outlet formed on a bottom thereof so as to dispense medication; a drum installed inside of the cartridge case so as to selectively open and/or close the outlet; and a cartridge base having the cartridge case installed thereto, wherein, projections projected downward and grooves recessed upward are formed on a bottom of the drum, alternatively, and a concave-convex part having protruding portion protruding upward are formed on a bottom surface of the cartridge case at intervals.

The concave-convex part may be disposed below the drum, and may include a ring member, having an accommodating groove recessed downward on a top surface thereof at intervals, and a ball member which rolls while being disposed in the accommodating portion of the ring member.

The projections and the grooves may be formed only along a circumference of the drum so as to be in contact with the concave-convex part.

The projections and the grooves may be connected to each other in a curved manner with a wave pattern.

Other features and aspects will be apparent from the following detailed description, the drawings, and the claims.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

Figure 1:
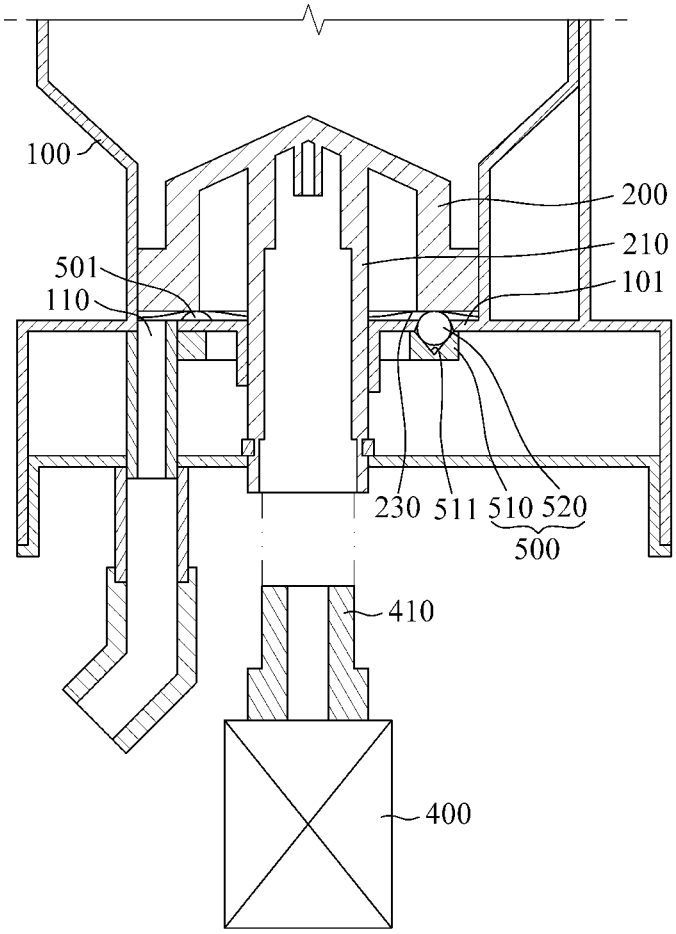
FIG. 1 is a cross sectional view illustrating an example in which a cartridge for a medication dispensing apparatus having a roll-rotating drum is in a raised position according to an exemplary embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will suggest themselves to those of ordinary skill in the art. Also, descriptions of well-known functions and constructions may be omitted for increased clarity and conciseness.

Figure 2:
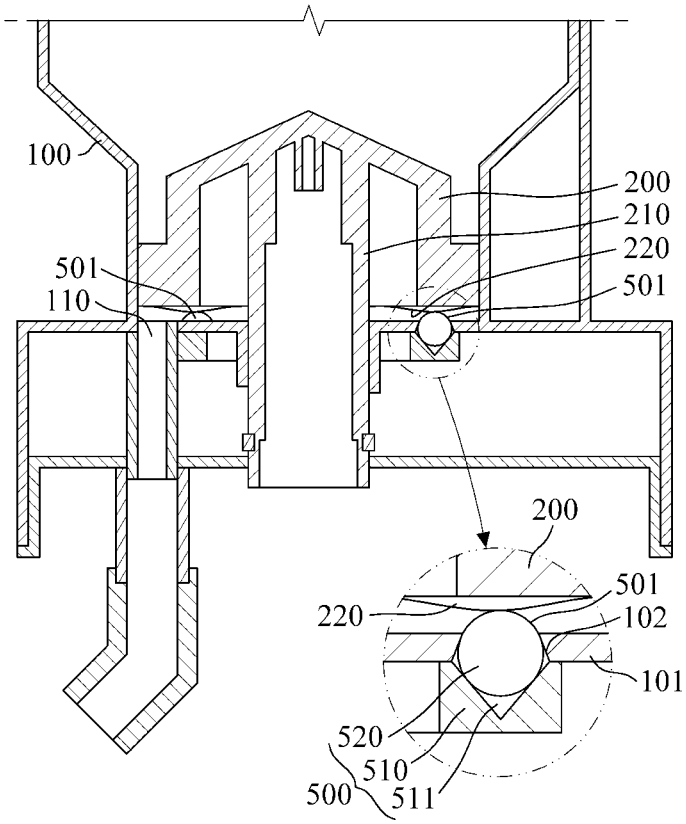
FIG. 2 is a cross sectional view illustrating an example in which a cartridge for a medication dispensing apparatus having a roll-rotating drum is in a lowered position according to an exemplary embodiment of the present invention.

FIG. 1 is a cross sectional view illustrating an example in which a cartridge for a medication dispensing apparatus having a roll-rotating drum is raised, and FIG. 2 is a cross sectional view illustrating an example in which a cartridge for a medication dispensing apparatus having a roll-rotating drum is lowered.

According to an exemplary embodiment of the present invention, a cartridge for a medication dispensing apparatus having a roll-rotating drum includes a cartridge case 100 having an open outlet 110 formed on the bottom thereof to dispense contained medication, a drum 200 installed inside of the cartridge case 100 to thereby selectively open the outlet 110, a cartridge base (not shown) having the cartridge case 100 installed thereto. In addition, on the bottom of the drum 200, projections 220 projected downward and grooves 230 recessed upward are formed one by one alternatively. Moreover, a concave-convex part 500 having a protrusion 501 protruding upward is formed on a bottom surface 101 of the cartridge case 100, which is in contact with a bottom surface of the drum 200.

The cartridge case 100 is configured to have an inner space and include an open top. Accordingly, medication may be supplied through the top and then contained in the inner space of the cartridge case 100. The medication may be various types of medications, such as a tablet and powder. On the bottom of the cartridge case 100, an outlet 110 is formed to dispense the medication.

The drum 200 is installed inside of the cartridge case 100 so as to selectively open and/or close the outlet 110. That is, the drum 200 is connected to a driving means 400 fixed to a cartridge base (not shown) to which the cartridge case 100 is installed, and the drum 200 is rotated in accordance with a prescription signal to open and/or close the outlet 110. The drum 200 and the driving means 400 are connected to each other through the cylinder 210 which is formed on the bottom of the drum 200 in an extended manner. In more detail, at the event when the rotation shaft 410 is inserted into the cylinder 210, if the driving means 400 is rotated, the drum 200 may be rotated. The driving means 400 may be controlled by a control unit which controls overall operations of a medication dispensing apparatus.

Conventionally, the drum 200 is disposed on the bottom surface 101 of the cartridge case 100, and, when being rotated on a horizontal state, opens the outlet 110 of the cartridge case 100. In such a case, if a large amount of medication is contained in the drum 200, the medication is not distributed equally to each cell 240 of the drum 200, because of weight and pressure of the medication. In order to solve the drawback, in the embodiment of the present invention, the projections 220 projected downward and the grooves 230 recessed upward are alternatively formed on the bottom of the drum 200, whereas the concave-convex part 500, having the protrusions 501 protruding at intervals, are formed on the bottom surface 101 of the cartridge case 100. The concave-convex part 500 may be a part integrated with the bottom surface 101 of the cartridge case 100 by processing the bottom surface 101 of the cartridge case 100 to be projected at intervals, or may be a separate part to be combined with the bottom surface 101 of the cartridge case 100.

Figure 5:
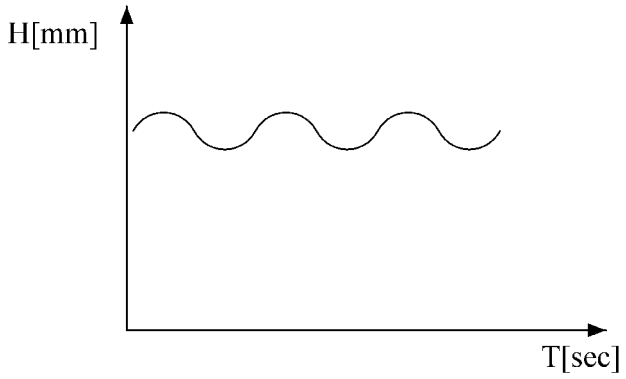
FIG. 5 is a graph illustrating displacement of a drum, shown in FIG. 1, when the drum is being rotated.

FIG. 5 is a graph illustrating displacement of a drum, shown in FIG. 1, when the drum is being rotated. If a concave-convex pattern ↔ is formed on the bottom of the drum 200, as described above, the drum 200 is rotated by moving upward and downward respectively in a clattering manner due to the concave-convex part 500, thereby preventing concentration of medication and thus distributing the medication equally to each of the cells 240 of the drum 200. Meanwhile, a ball bearing, which is in the form of a ring being exposed upward to be in contact with the bottom of the drum 200 may substitute for the concave-convex part 500.

If the concave-convex part 500 is formed such to be separate from the cartridge case 100, the concave-convex part 500 may be disposed above the bottom 101 of the cartridge case 100, or may be disposed in a lower part of the cartridge case 100. In more detail, if the concave-convex 500 is disposed above the bottom surface of the cartridge case 100, the concave-convex 500 is placed right below the drum 200 and right above the bottom surface 101 of the cartridge case 100. Alternatively, if the concave-convex 500 is disposed in the lower part of the cartridge case 100, the concave-convex 500 is disposed below the cartridge case 100, the concave-convex 500 may be fitted to an exposure groove 102 formed on the bottom surface 101 of the cartridge case 100 so as to allow an protruding portion 501 of the convex-concave 500 to be exposed toward the bottom of the drum 200. That is, using the exposure groove 101, the body of the concave-convex part 500 may be disposed in the lower part of the cartridge case 100, while the protruding portion of the concave-convex part 500 may protrude from the bottom surface 101 of the cartridge case so as to be in contact with the bottom of the drum 200.

FIG. 1 illustrates an example in which the drum 200 is in a raised state since the projection 220 of the drum 200 is in contact with the protruding portion 501 of the convex-concave 500. FIG. 2 illustrates an example in which the drum 200 in a lowered state since the groove 230 of the drum 200 is in contact with the protruding portion 501 of the convex-concave 500. As such, when the drum 200 is being rotated, the drum 200 may alternate between a raised state and a lowered state due to the projection 220 and the groove 230 of the drum 200, which are in contact with the protruding portion 501 of the concave-convex 500, alternatively. Along the rotation of the drum 200, medication contained in the cartridge case 100 may be distributed to each of the cells 240 of the drum 200.

Figure 3:
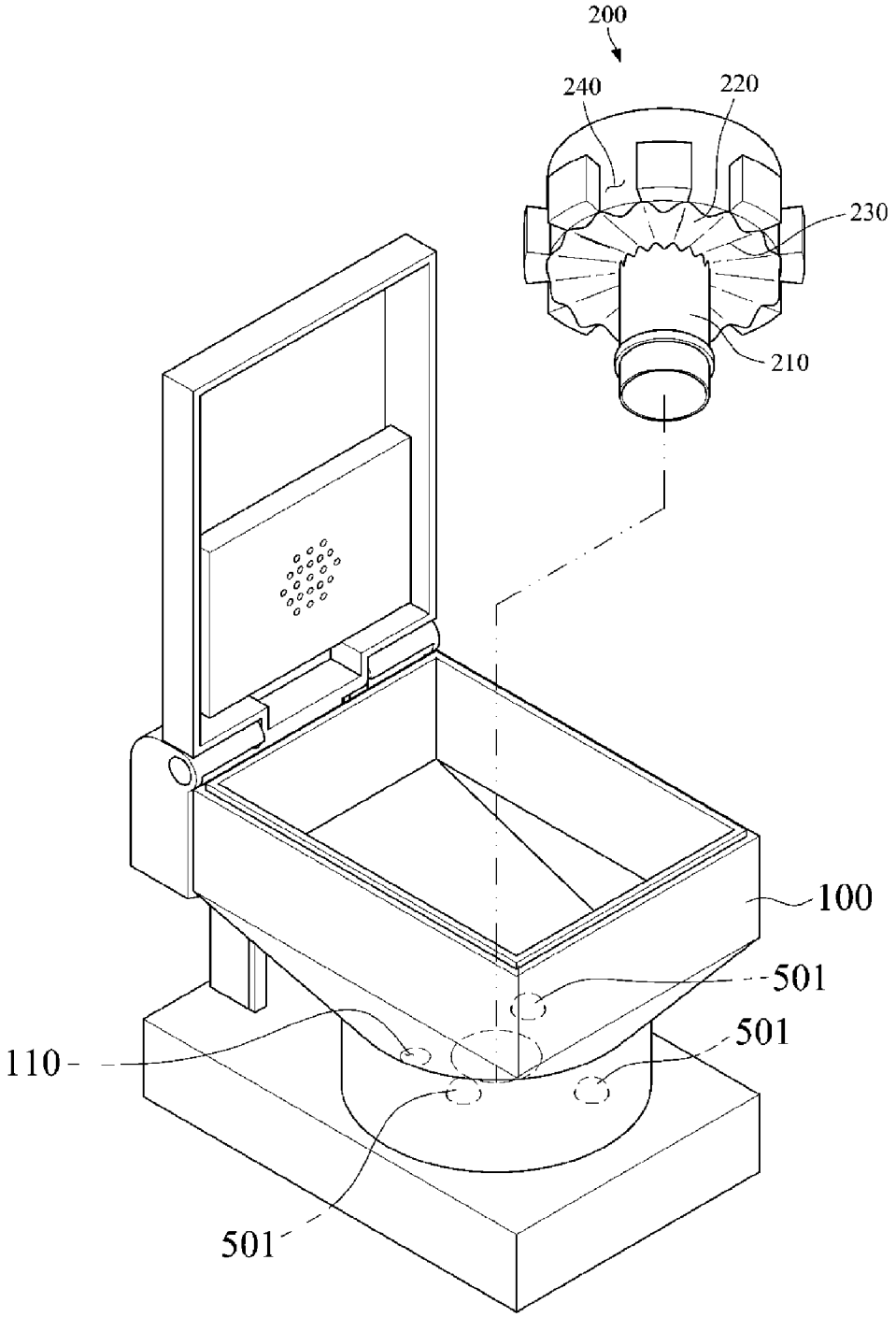
FIG. 3 is a bottom perspective view illustrating a drum shown in FIG. 1.
Figure 4:
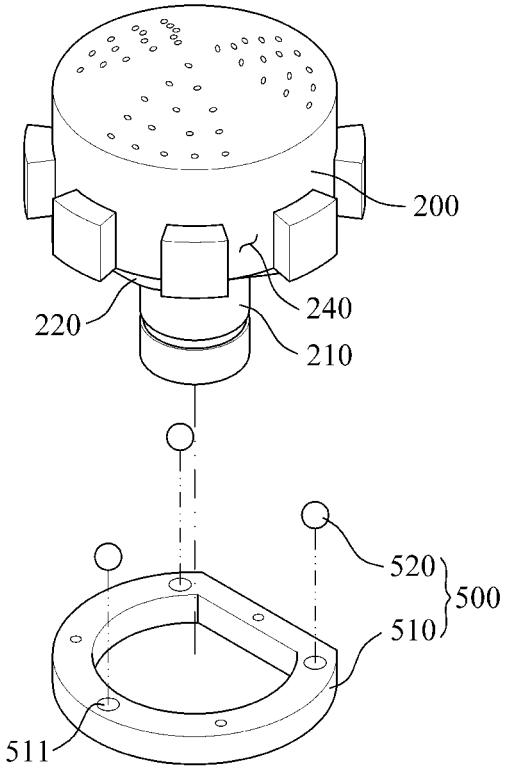
FIG. 4 is an exploded perspective view illustrating a drum and a concavo-convex part, both shown in FIG. 1.

FIG. 3 is a bottom perspective view illustrating a drum shown in FIG. 1, and FIG. 4 is an exploded perspective view illustrating a drum and a concave-convex, both shown in FIG. 1.

According to an exemplary embodiment of the present invention, the concave-convex 500 is disposed below the drum 200, and includes a ring member 510, which has an accommodating groove 511 recessed downward on the top surface of the ring member 510 at intervals, and a ball member 520 which rolls while being disposed in the accommodating groove 511 of the ring member 510. As described above, the concave-convex 500 may be in the form of a ball bearing. If the ball member 520, which rolls while being disposed in the accommodating groove 511 of the right member 510, protrudes toward the bottom surface 101 of the cartridge case 100 to thereby act as the protruding portion 501 of the concave-convex 500, the concave-convex 500 is able to raise the drum 200 simply by making contact with the projection 220 and the groove 230 of the drum 200 alternatively. In addition, the concave-convex 500 is able to play a role as a bearing which reduces fractional force to allow the drum 200 to rotate easily.

The projection 220 and the groove 230 are formed only along a circumference of the bottom of the drum 200 so as to be in contact with the concave-convex 500. That is, the projection 220 and the groove 230 may be formed on the entire bottom of the drum 200, or may be formed only along a circumference of the bottom of the drum 200 so as to be in contact with the concave-convex 500.

The projection 220 and the groove 230 are configured to be connected to each other in a curved manner with a wave pattern. That is, the projection 220 and the groove 230 may be in various forms as long as a concave-convex pattern ↔ is able to be formed on the bottom of the drum 200. If the projection 220 and the groove 230 are connected in a curved manner, a wave pattern may be made. In addition, when being rotated, the drum 200 may be raised and lowered repetitively, since the projection 220 and the groove 230, each of which is included in the drum 200, are to be in contact with the protruding portion 501 of the concave-convex part 500, alternatively. That is, the drum 200 is raised and lowered repetitively by the protruding porting 501, operational efficiency thereof is as efficient as that of the drum 200 being rotated on a flat plate. In this way, it is possible to distribute medication equally to each of the cells 240 of the drum 200.

According to an exemplary embodiment of the present invention, the number $T_{roll}$ of both the projections 220 and the grooves 230 needs to be equal or greater than the number $T_{DRUM}$ of the cells 240 of the drum 200. In more detail, if the number $T_{roll}$ of both the projections 220 and the grooves 230 are two times greater than the number $T_{DRUM}$ of the cells 240 of the drum 200, as shown in the following Equation 1, the drum 200 is raised and lowered at least once with respect to each cells 240. In this way, it is possible to distribute medications more effectively.

$$T_{ROLL} \geq 2 \cdot T_{DRUM} \quad \text{[Equation 1]}$$

In the above-described exemplary embodiments of the present invention, even in the event that over concentration of medication occurs due to weight of the medication, it is possible to ease the concentration and thus supply the medication to each cell more rapidly and reliably.

In addition, it is possible to quickly respond to congestion of dispensing medication, thereby improving productivity in a medication dispensing process.

Moreover, a rotational load of a drum may be reduced, and a time for dispensing medication may become shorter because medication is distributed equally to each cell of the drum. Unnecessary energy consumption and a loss of tablets may be prevented since the drum is kept from being rotated arbitrarily when a cartridge case is detached from a cartridge base.

Furthermore, it is possible to easily resolve a jam which occurs when medication is stuck in the drum. In addition, if a tablet is adhered to the drum due to static electricity or if the last tablet is stuck in the drum, it is possible to dispense the tablet quickly.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A cartridge for a medication dispensing apparatus having a roll-rotating drum, the cartridge comprising:

a cartridge case having an open outlet formed on a bottom thereof so as to dispense medication;

a drum installed inside of the cartridge case so as to selectively open and/or close the outlet; and a cartridge base having the cartridge case installed thereto, wherein in the cartridge case encloses an inner space configured to contain the medication to be dispensed, wherein, projections projected downward and grooves recessed upward are formed alternatively on a bottom of the drum in a circumferential direction, and a concave-convex part having protruding portion protruding upward are formed in a circumferential direction on a bottom surface of the cartridge case at intervals, and wherein a rotation of the drum results in a upward and downward movement of the drum relative to the concave-convex part as the projections and grooves of the drum traverse over the protruding portion of the concave-convex part in a circumferential direction.

2. The cartridge of claim 1, wherein the concave-convex part is disposed below the drum, and comprises a ring member, having an accommodating groove recessed downward on a top surface thereof at intervals, and a ball member which rolls while being disposed in a accommodating portion of the ring member.

3. The cartridge of claim 1, wherein the projections and the grooves are formed only along a circumference of the drum so as to be in contact with the concave-convex part.

4. The cartridge of claim 1, wherein the projections and the grooves are connected to each other in a curved manner with a wave pattern.

* * * * *